US009265388B2

(12) United States Patent
Yehuda et al.

(10) Patent No.: US 9,265,388 B2
(45) Date of Patent: Feb. 23, 2016

(54) COMBINATION TOILET CLEANING DEVICE

(71) Applicants: Hillel Bar Yehuda, Kfar Chabad (IL); Simha Lebenhartz, Kfar Chabad (IL)

(72) Inventors: Hillel Bar Yehuda, Kfar Chabad (IL); Simha Lebenhartz, Kfar Chabad (IL)

( * ) Notice: Subject to any disclaimer, the term of this patent is extended or adjusted under 35 U.S.C. 154(b) by 489 days.

(21) Appl. No.: 13/744,955

(22) Filed: Jan. 18, 2013

(65) Prior Publication Data

US 2013/0220370 A1 Aug. 29, 2013

Related U.S. Application Data

(60) Provisional application No. 61/594,065, filed on Feb. 2, 2012.

(51) Int. Cl.

| | |
|---|---|
| ***B08B 9/00*** | (2006.01) |
| ***A47K 11/10*** | (2006.01) |
| ***A47K 17/00*** | (2006.01) |
| ***E03D 9/00*** | (2006.01) |

(52) U.S. Cl.

CPC ..... *A47K 11/10* (2013.01); *A47K 17/00* (2013.01); *E03D 9/00* (2013.01)

(58) Field of Classification Search

None

See application file for complete search history.

(56) References Cited

U.S. PATENT DOCUMENTS

| | | | |
|---|---|---|---|
| 6,804,839 | B1 | 10/2004 | McMaster |
| 7,299,519 | B1 | 11/2007 | Garry |
| 7,430,779 | B1 | 10/2008 | Garry |

*Primary Examiner* — Eric Golightly

(74) *Attorney, Agent, or Firm* — Greenberg Traurig, LLP

(57) ABSTRACT

A combination toilet brush/plunger apparatus for providing both a plunger and a toilet cleaning brush in one unit. The combination toilet brush/plunger apparatus includes a brush assembly including a brush support member. The brush member is attached to the brush support member, and there is an elongate handle member being removably attached to the brush support member. A plunger assembly includes a housing/support member. The plunger member is attached to the housing/support member with the brush support member being removably fastened to the housing/support member. There is a plate with apertures disposed in the housing/support member.

12 Claims, 11 Drawing Sheets

(a)

(b)

(a)

(b)

COMBINATION TOILET CLEANING DEVICE

RELATED APPLICATION

This application relates to U.S. Provisional patent 61/594,065 entitled Combination Toilet Cleaning Device filed Feb. 2, 2012. The contents are incorporated by reference herein.

FIELD OF THE DISCLOSURE

This disclosure relates to a toilet brush for cleaning toilet bowls.

BACKGROUND

Regular cleaning of toilets and urinals is required in order that the devices continue to operate properly. Furthermore, regular bathroom service requires that deodorant blocks and urinal screens have to be moved and replaced from time to time.

There is a need for a device which allows safe and effective grasping and removal of a variety of items from toilets and urinals and further includes a brush for cleaning the toilets and urinals.

SUMMARY

The disclosure includes a combination toilet brush/plunger for providing both a plunger and a toilet cleaning brush in one unit. The combination toilet brush/plunger includes a brush assembly including a brush support member, and also including a brush member being attached to the brush support member, and further including an elongate handle member being removably attached to a plunger. The plunger assembly a connector rod for removable attachment at the end of the brush on end removed from the handle. There is dish shaped member above the brush on the side removed from the plunger which can be used to hook out elements from the toilet by withdrawing the brush from the toilet bowl.

The disclosure provided a brush head mounted on the handle for use in cleaning. The dish or rim like element at the base of the handle permits the removal of the desired object.

A janitorial device is operable with the handle as a replaceable cleaning brush mounted at one end of the handle, or a plunger mounted on the handle or on the side the brush remote from the handle, and as a hook like plate or device is transversely mounted at the end near the brush head to extend a required distance diametrically of the handle to permit object to be picked up.

The disclosure will be further described with respect to the following drawings and detailed description.

BRIEF DESCRIPTION OF THE DRAWINGS

The above-mentioned features and objects of the present disclosure will become more apparent with reference to the following description taken in conjunction with the accompanying drawings wherein like reference numerals denote like elements and in which.

DETAILED DESCRIPTION

Figure 1:
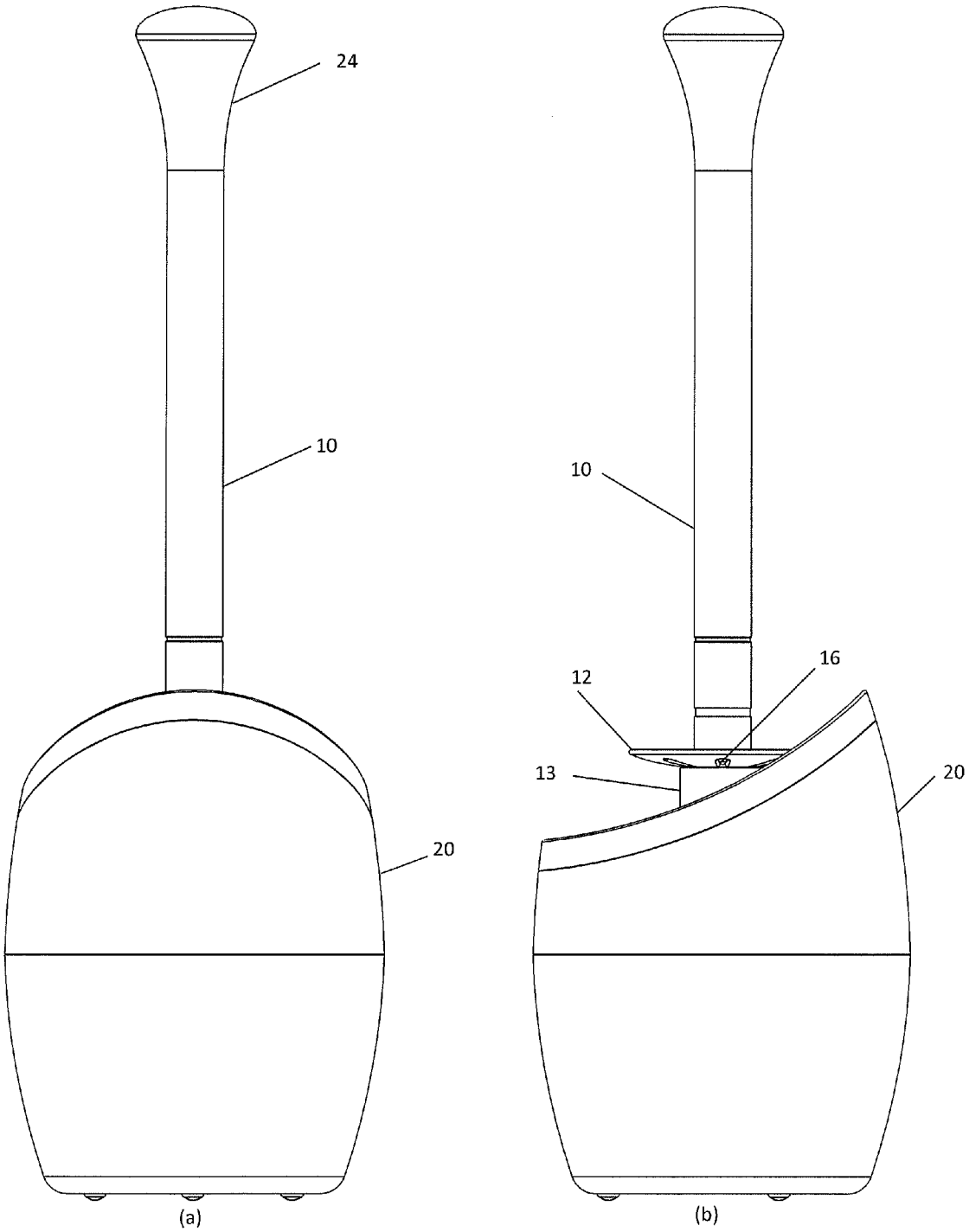
FIG. 1*a* is a rear view of the toilet brush in the holder.
FIG. 1*b* is a side view of the toilet brush in the holder.
Figure 2:
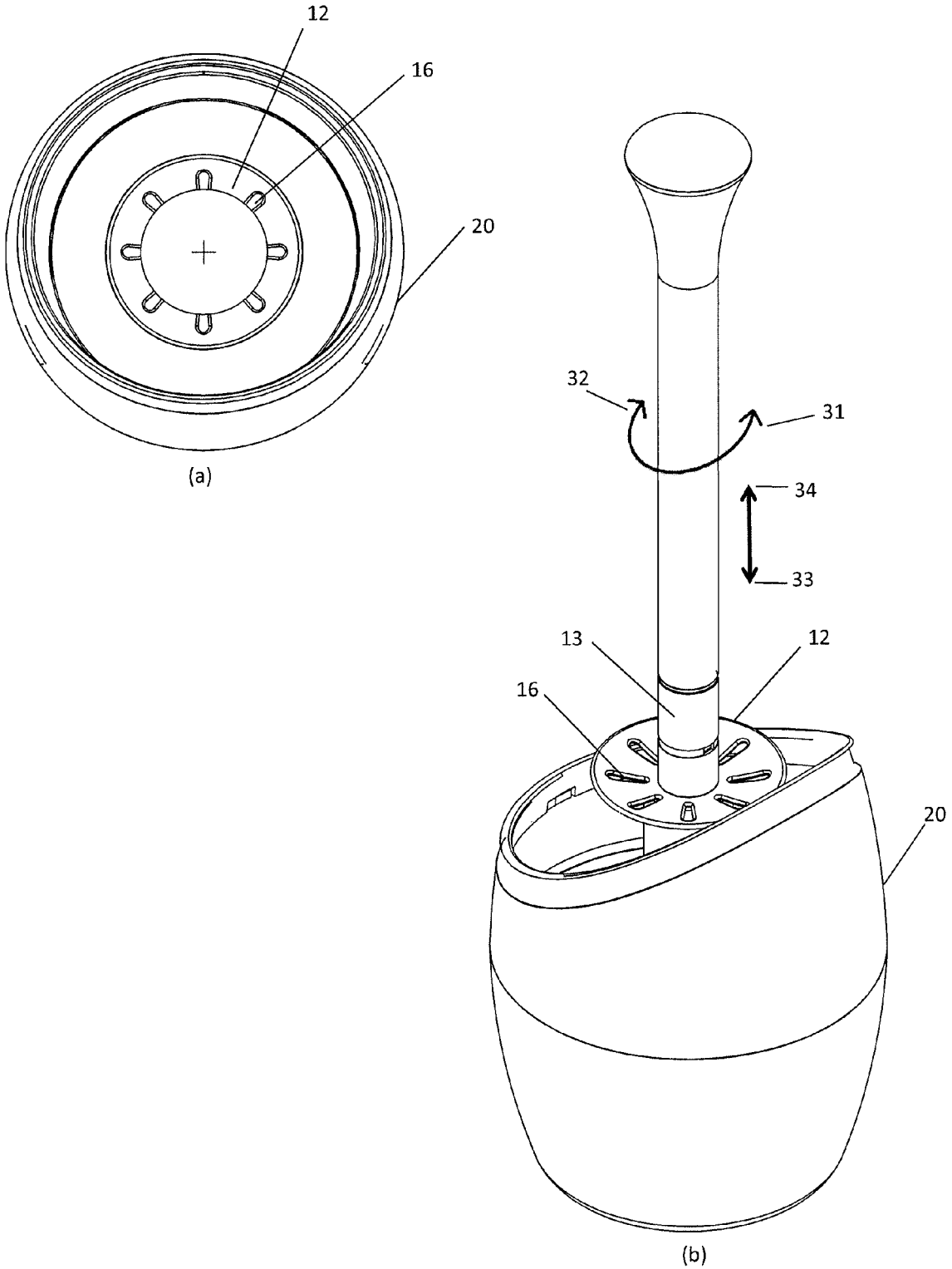
FIG. 2*a* is a top view of the toilet brush in the holder.
FIG. 2*b* is a top perspective view of the toilet brush in the holder.
Figure 3:
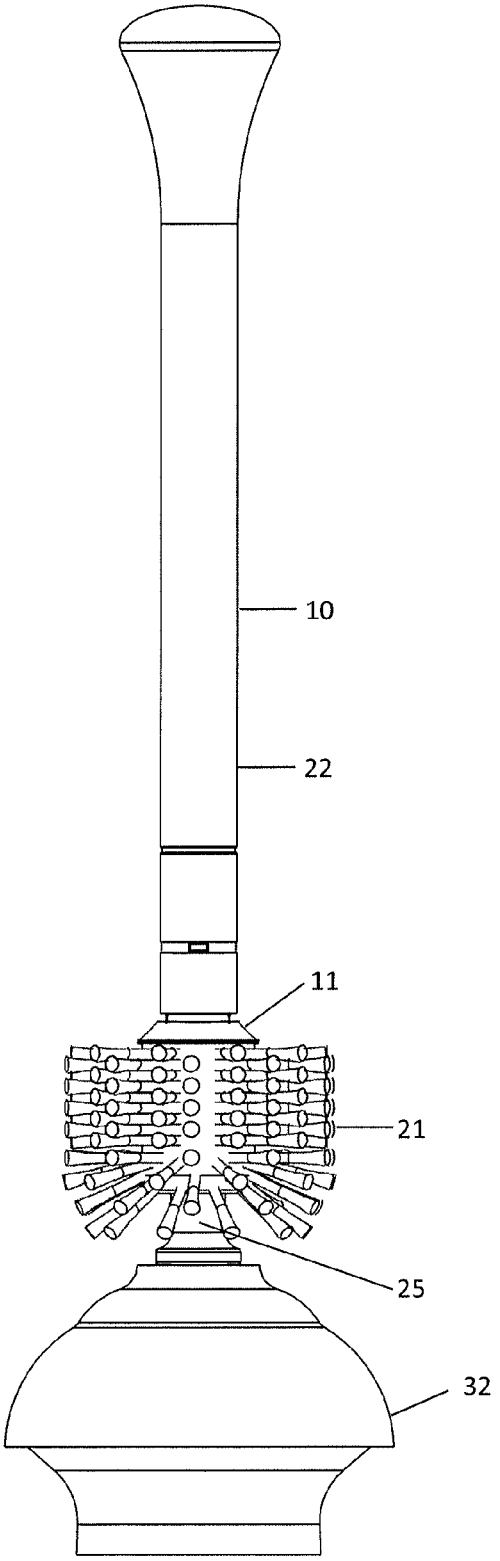
FIG. 3*a* is a side view of the toilet brush and plunger.
FIG. 3*b* is a top perspective view of the toilet brush and plunger.
Figure 3:
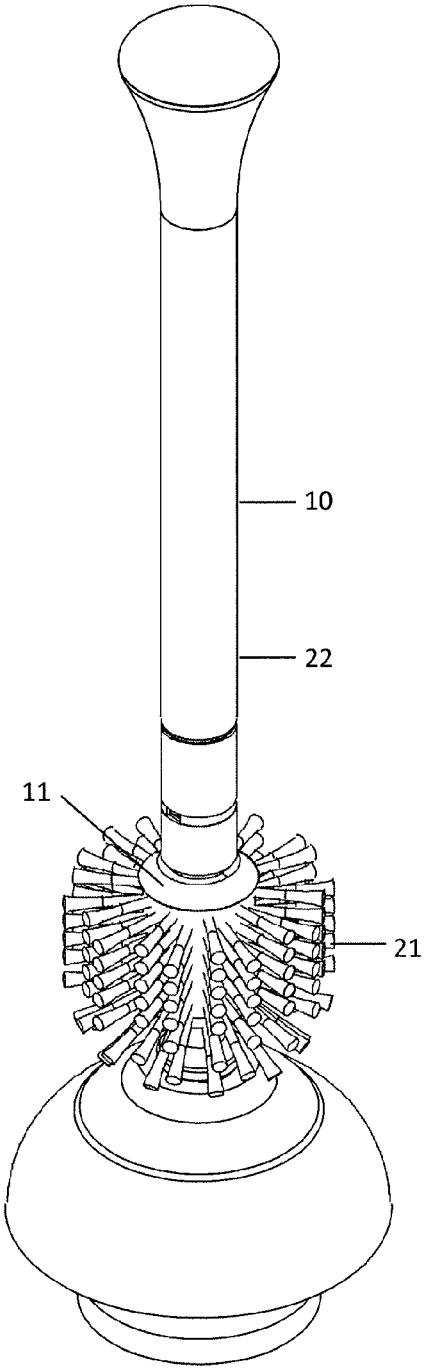
Figure 4:
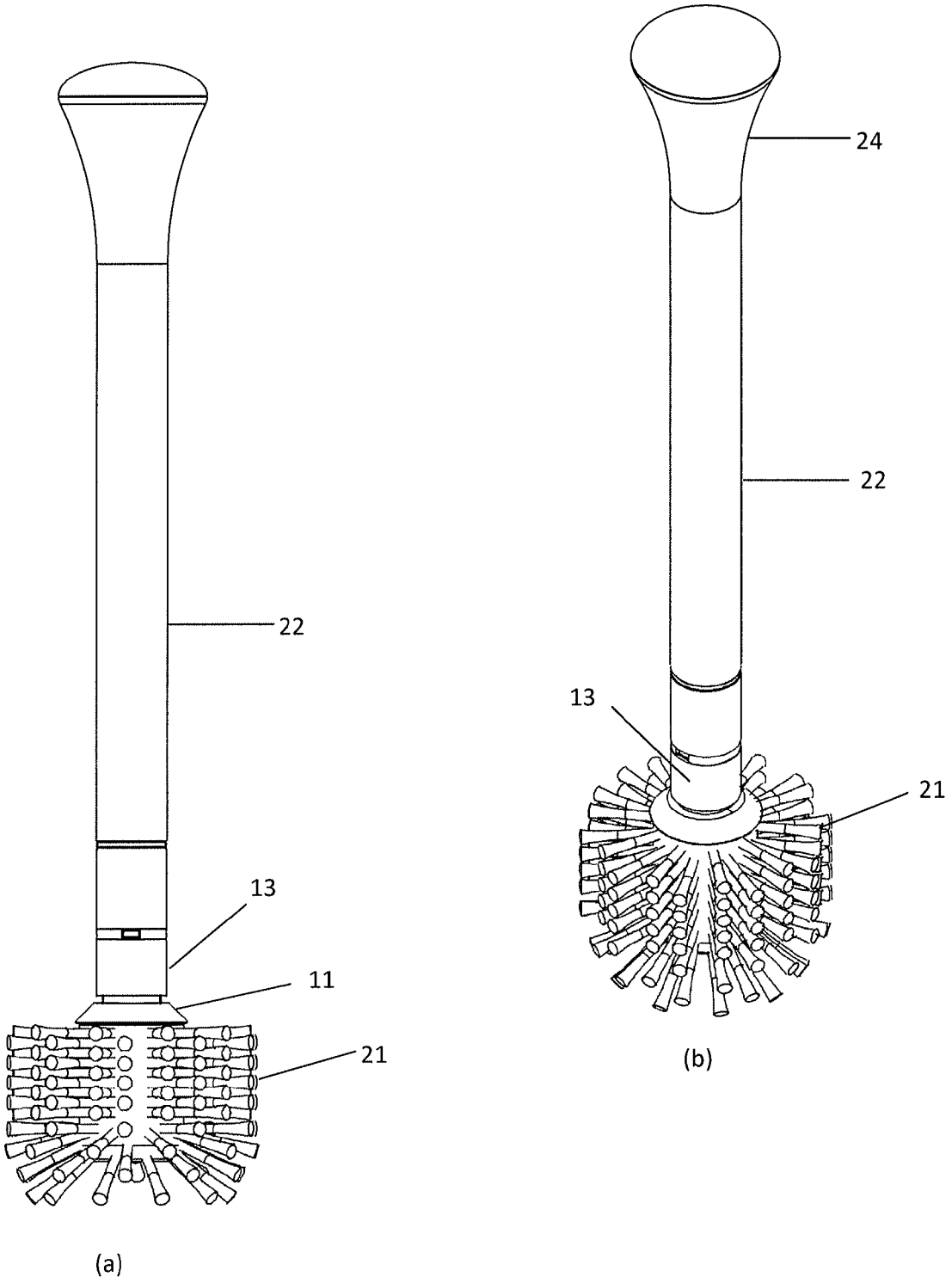
FIG. 4*a* is a side view of the toilet brush without the plunger.
FIG. 4*b* is a top perspective view of the toilet brush without the plunger.
Figure 5:
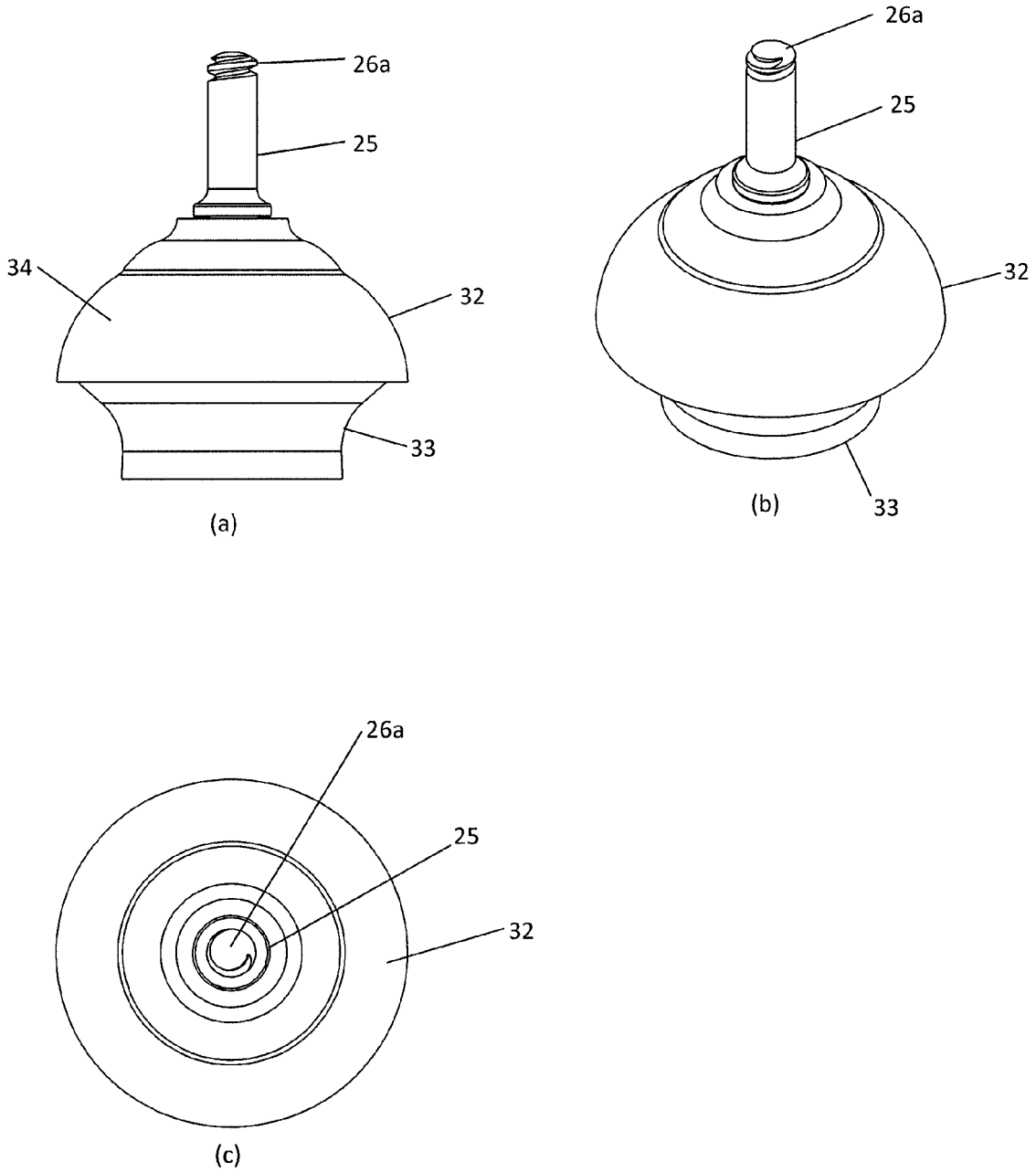
FIG. 5*a* is a side view of the toilet plunger.
FIG. 5*b* is a perspective top view of the toilet plunger.
FIG. 5*c* is a top view of the toilet plunger.
Figure 6:
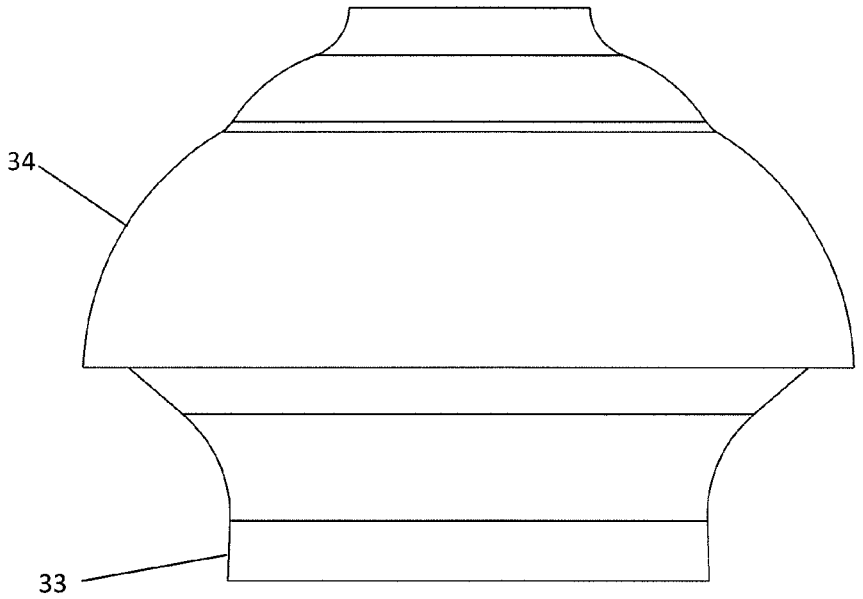
FIG. 6*a* is a side view of the toilet plunger without the connector.
FIG. 6*b* is a perspective top view of the toilet plunger without the connector.
Figure 6:
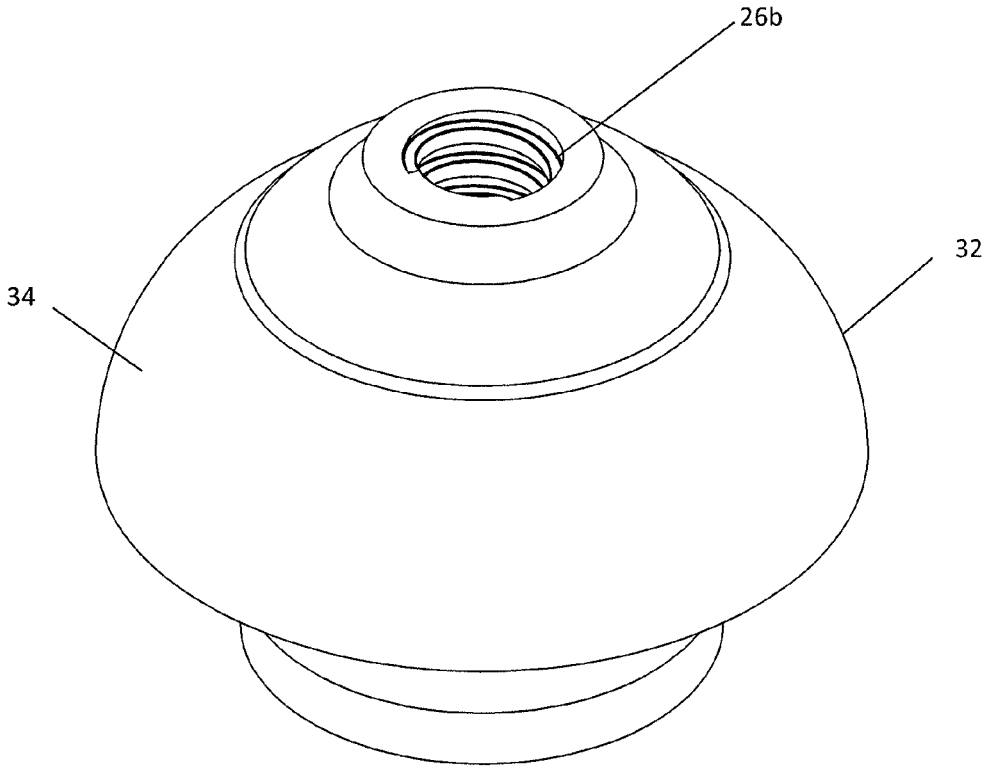
Figure 7:
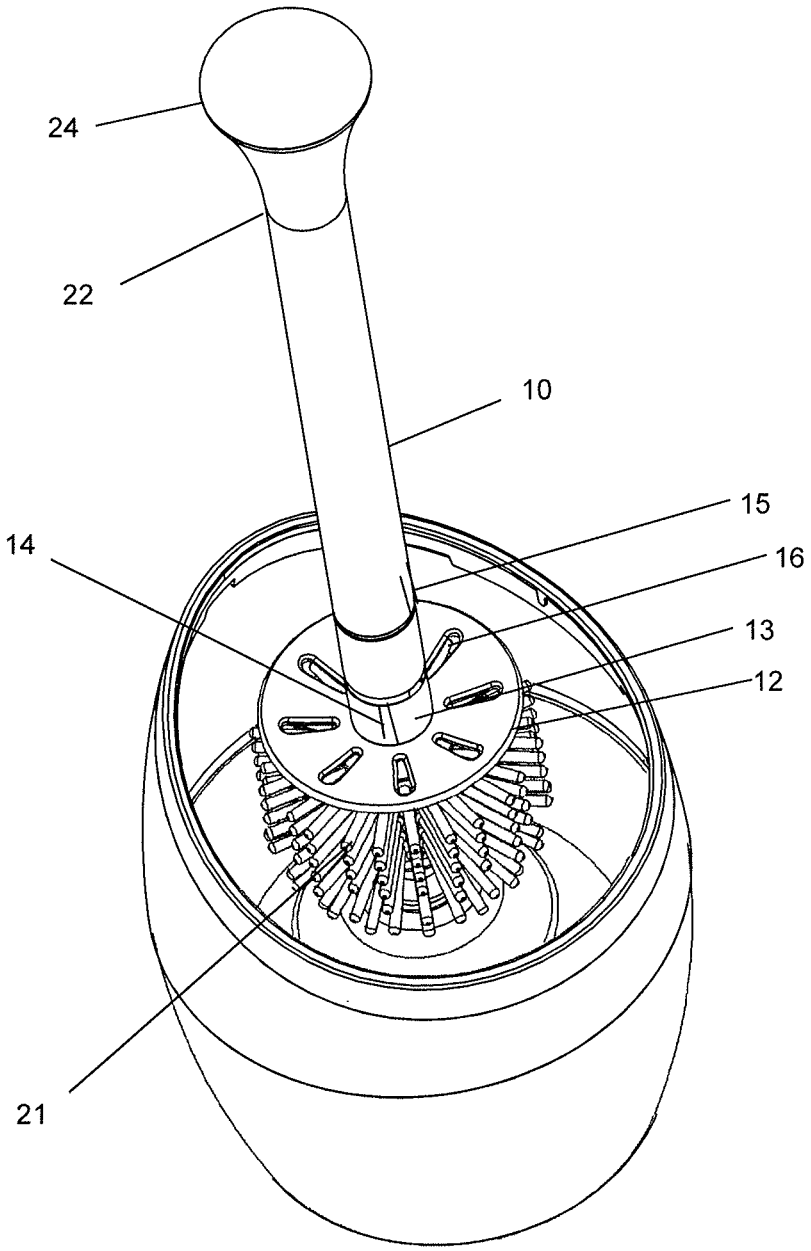
FIG. 7 is a perspective top view of the toilet brush in the holder.
Figure 8:
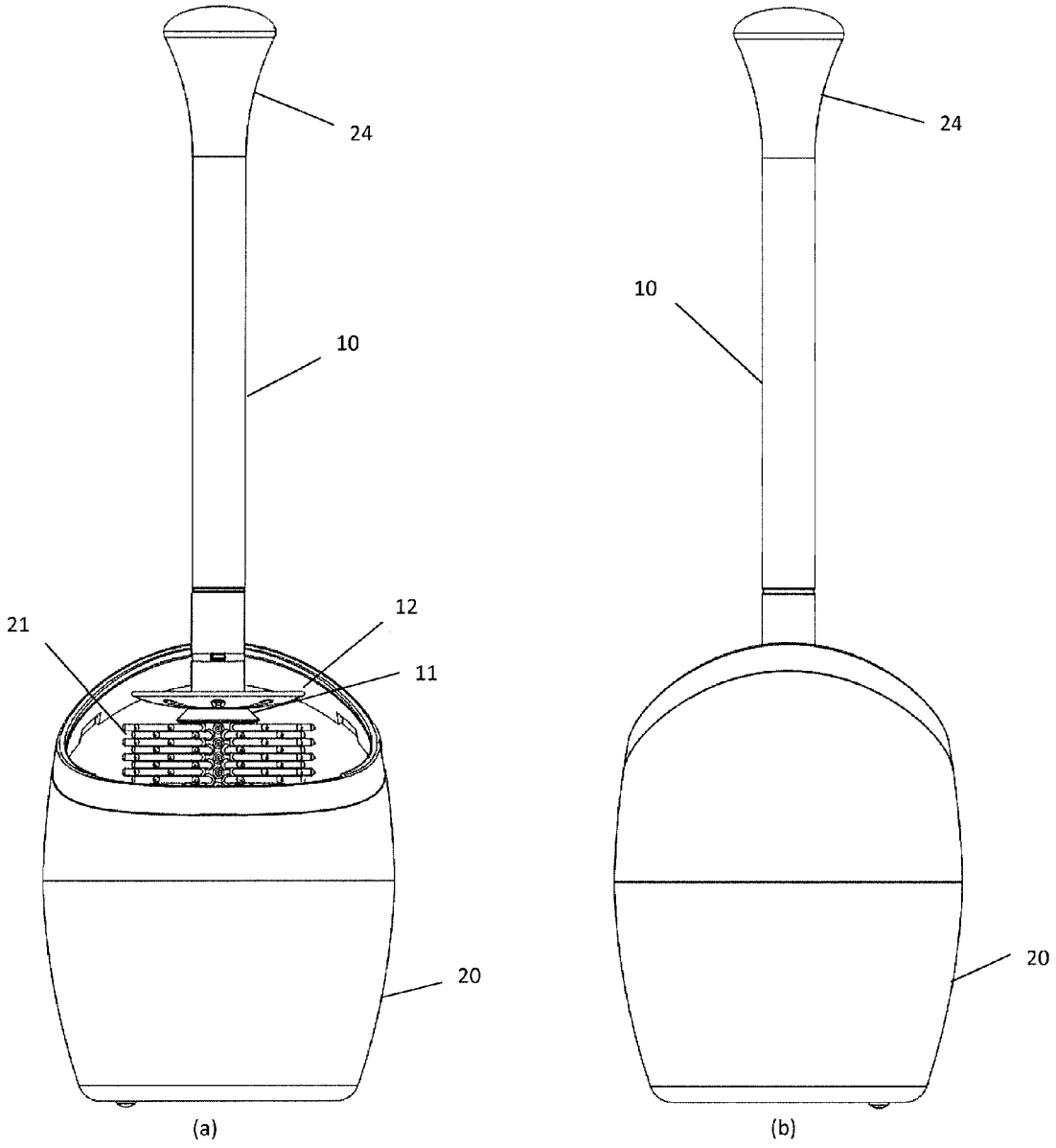
FIG. 8*a* is a side view of the toilet brush in the holder.
FIG. 8*b* is a rear view of the toilet brush in the holder.
Figure 9:
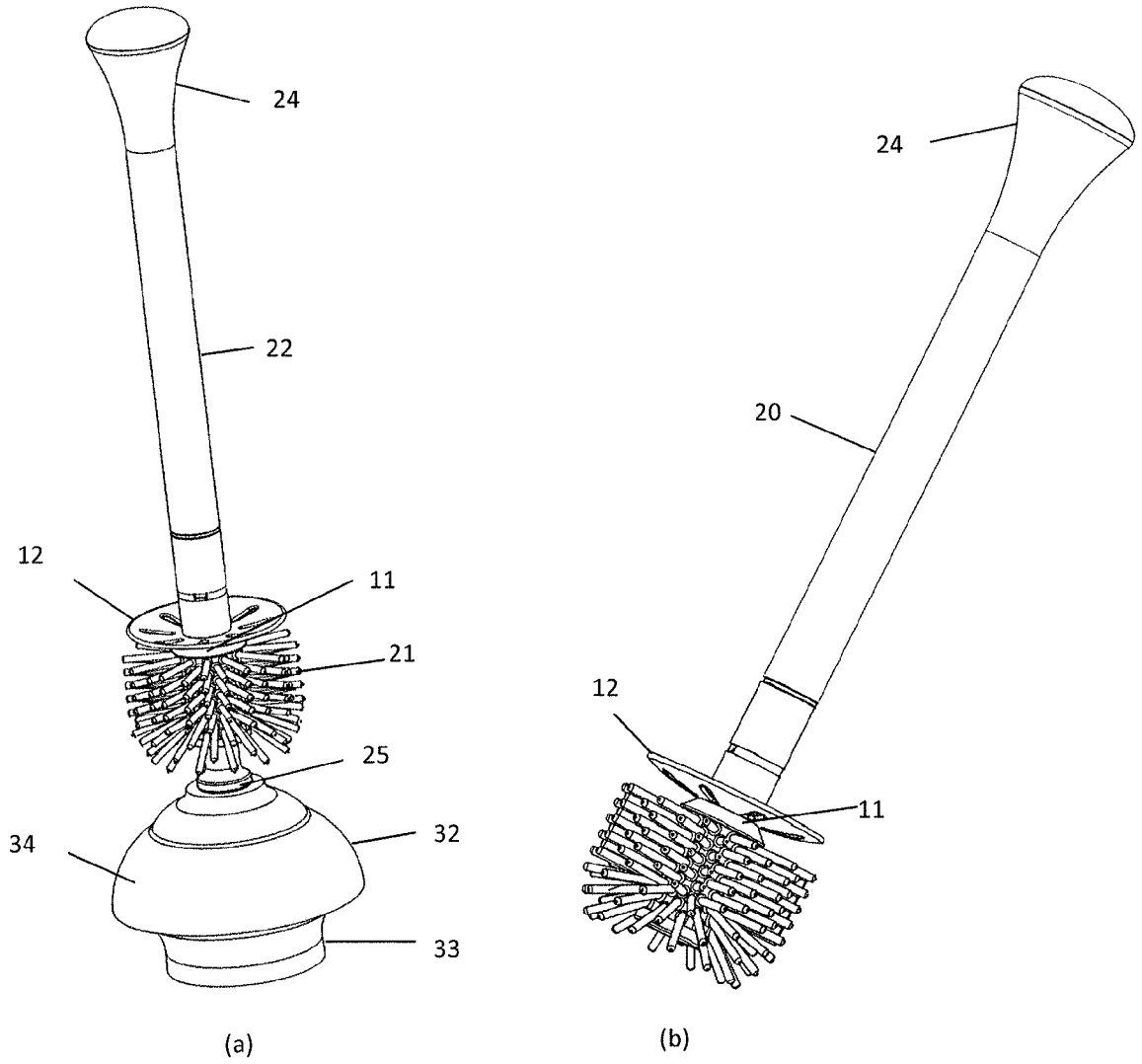
FIG. 9*a* is a perspective view of the toilet brush and toilet plunger connected.
FIG. 9*b* is a perspective view of the toilet brush.
Figure 10:
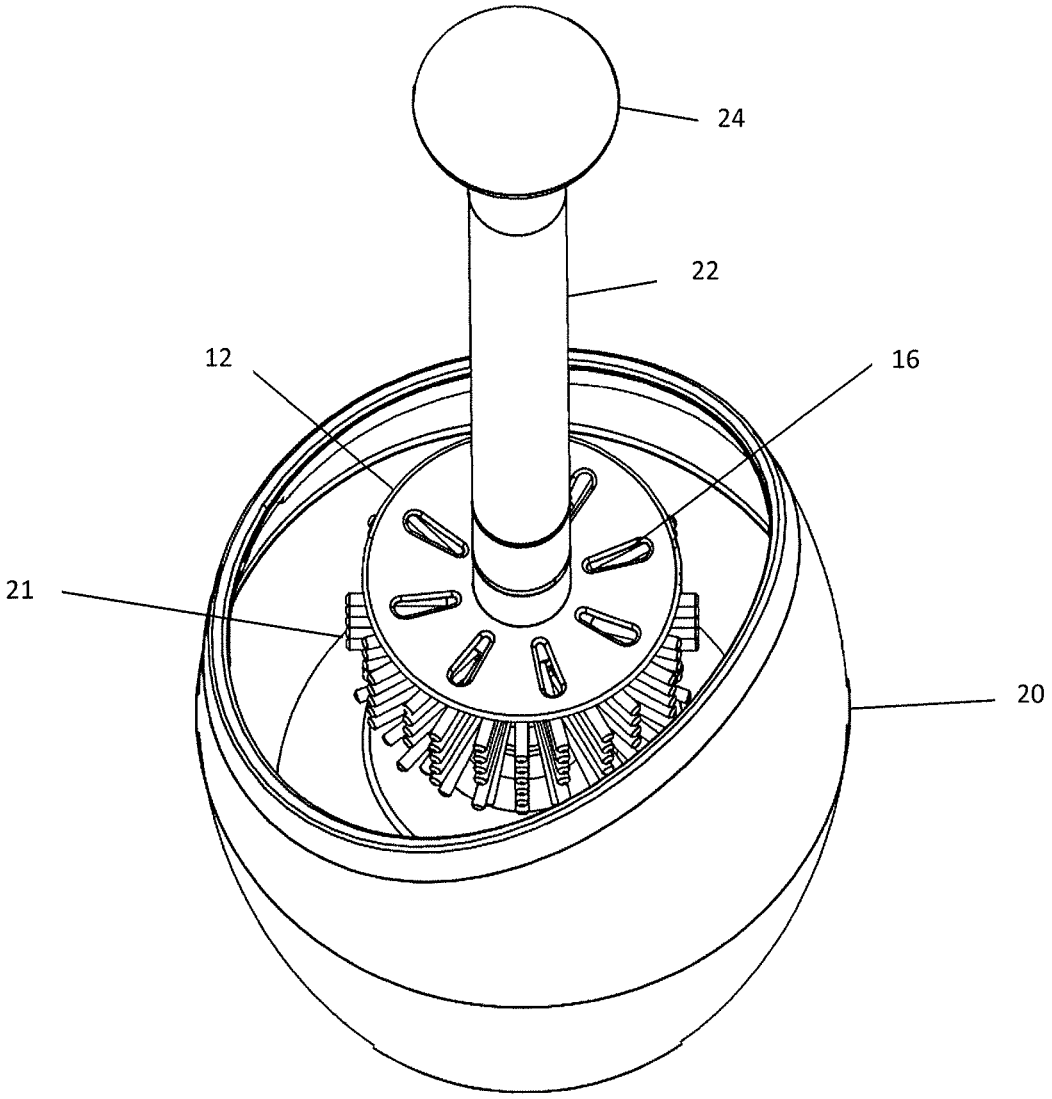
FIG. 10 is a perspective top view of the toilet brush in the holder.
Figure 11:
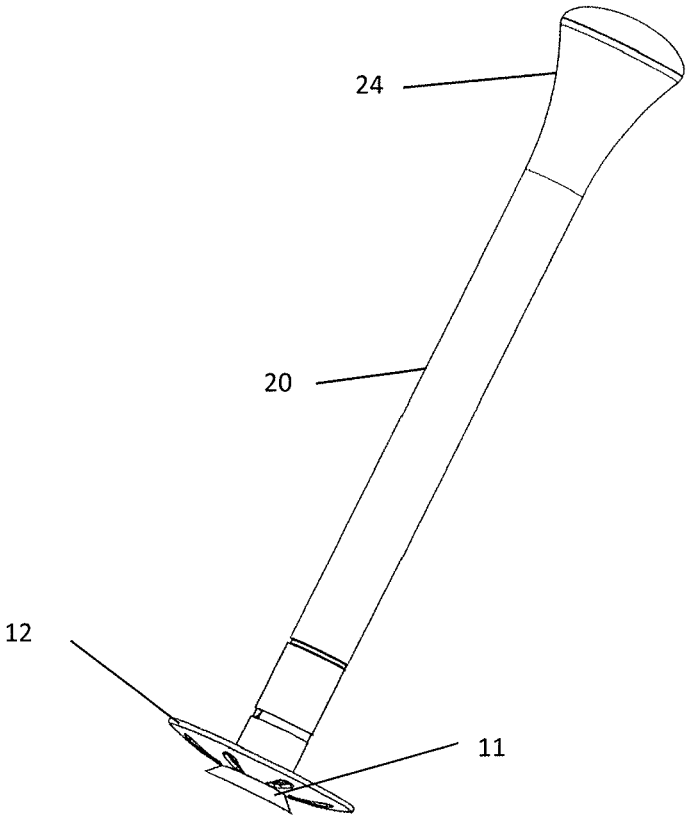
FIG. 11 is another perspective view of the toilet brush.

The disclosure is further described.

The janitorial implement according to the disclosure includes a new combination toilet brush/plunger apparatus which has many of the advantages of the combination plungers/brushes and cleaning hooks.

A janitorial device for cleaning a toilet bowl comprises a handle with selectively a combination of firstly either a cleaning brush mounted at one end of the handle, a plunger mounted on the handle on the side the brush remote from the handle, and/or a hook like plate or device transversely mounted at the handle end near the brush to extend a required distance diametrically of the handle to permit an object in a toilet bowl to be picked up.

Secondly there are at least two of the cleaning brush mounted at one end of the handle, the plunger mounted on the handle on the side the brush remote from the handle, and the hook like plate or device transversely mounted at the handle end near the brush.

The third alternative is at least three of the cleaning brush mounted at one end of the handle, the plunger mounted on the handle on the side the brush remote from the handle, and the hook like plate or device transversely mounted at the handle end near the brush.

The device includes the plate with apertures in the surface through which water or fluid can drain and trap solid articles above the plate. The plate surface has a curve so that the peripheral rim is located upwardly of the base of the plate in the vicinity of the handle. In this manner, objects will be more inclined to stay in the plate when they are trapped on the surface. In other cases, the plate can be flat and have a an upwardly directed rim for the same purposes as facilitating entrapment on the plate.

A janitorial device for cleaning a toilet bowl comprises a handle with selectively a combination of a cleaning brush mounted at one end of the handle, a plunger mounted on the handle on the side the brush remote from the handle, a hook like plate or device transversely mounted at the handle end near the brush to extend a required distance diametrically of the handle to permit an object in a toilet bowl to be picked up, and the plate having apertures in the surface through which water or fluid can drain and trap solid articles above the plate.

There is a method of using a janitorial device for cleaning a toilet bowl comprising the steps of:

applying a handle with selectively having a combination of firstly either a cleaning brush mounted at one end of the handle, a plunger mounted on the handle on the side the brush remote from the handle, and/or a hook like plate or device transversely mounted at the handle end near the brush to extend a required distance diametrically of the handle to permit an object in a toilet bowl to be picked up, or applying secondly at least two of the cleaning brush mounted at one end of the handle, the plunger mounted on the handle on the side the brush remote from the handle, the hook like plate or device transversely mounted at the handle end near the brush or applying thirdly at least three of the cleaning brush mounted at one end of the handle, the plunger mounted on the handle on the side the brush remote from the handle, and the hook like plate or device transversely mounted at the handle end near the brush.

The method is operable where the plate includes apertures in the surface, and draining water or fluid through the apertures and trapping solid articles above the plate.

A brush assembly including a brush support member. A brush member is attached to the brush support member, and an elongate handle member is removably attached to the brush support member. There is a plunger assembly including a housing/support member and also including a plunger member being attached to the housing/support member with the brush support member being removably fastened to the housing/support member. A dish or plate lie hook member is selectively removably disposed around the handle above the brush.

The combination toilet brush/plunger apparatus 10 generally comprises a brush assembly including a brush support member 11. A brush member 21 is attached to the brush support member 11. An elongate handle member 22 is removably attached and fastened to the brush support member 11. The brush support member 11 can removable and selectively include a plate 12, and also includes a tubular connector 13 being centrally disposed in and through the plate 12 which has holes 16 extending there through. There are elongate threaded members 14 being attached to a top side of the plate 12, and fasteners threaded on the elongate threaded members.

The brush member 21 can be securely attached to a bottom side of the plate 12, and is made of pliable material. The handle member 22 has an annular recessed bottom end portion 30 which is removably threaded 15 into the top end of the tubular connector 13, and also has a ribbed or expanded end portion 24 for a user to easily grip the handle member 22.

A plunger assembly includes a support member 25 and also includes a plunger member 32 being securely attached to the support member stub 25. The plunger is removable attached to the remote end of the brush 21. In other forms the plunger is removably fastened to the support member 25.

The elongate threaded members of the brush support member 11 are removably disposed with the support member 25 and are fastenable to the support member stub 25 by threading or bayonet connection configurations 26*a* and 26*b*. The threaded end 26*a* at the end of the stub is for engagement either on the bottom of the brush structure or on the bottom of the handle. The opposite end of the stub 25 has a thread for engagement with the threaded bore 26*b* at the top of the plunger 32.

The plunger member 32 is generally a suction cup having a bottom portion 33 and an accordion top portion 34 which is conventionally attachable to and about the open bottom of the support member 25.

There can be a protective guard assembly housing 20 removably disposed with the apparatus 10. The brush protective guard assembly housing 20 can be a cylindrical member having bottom and side walls and an open top and can be for securely and removably seating the apparatus 10 inside the open bottom of the housing member 20. There can be a threaded post member conventionally attached to a top side of bottom wall of the cylindrical member.

In use, the user would place the bottom portion 33 of the plunger member 32 over the plugged hole in the toilet and would push down upon the plunger member 32 using the handle member 22 which creates suction in the hole of the toilet to unplug the hole. In other cases the plate 12 with the holes 16 is used to hook our foreign objects from the toilet on retraction of the brush. In other cases the brush 11 cleans the toilet. There can be different combinations of the brush, and/or plunger, and/or plate attached to the handle in a removable manner. Thus there can be a combination of toilet brush and plunger: combination of brush and plate; combination brush, plunger and plate, and combination plunger and plate. All of these parts fit with a base 20 as needed for support when not in use. Plate 12 is made of silicone material and is a round plate which is used to hook foreign elements. This allow the brush to clean toilet bowel without hard plastic material interfering.

There are at least 5 different combination of system which can exit: handle plus plate with holes; handle plus brush; handle plus plunger; handle plus brush plus plunger; handle plus plate plus brush and plunger.

The connectors with the handle and plate; handle with brush; handle with plunger can be of a screw and/or bayonet type. These 5 different combinations of structure are possible with unscrewing or unbayoneting without handling of each of the plate; brush; or plunger. Similarly the screwing and/or bayoneting of components can be of nature that assembly in the 5 different combinations is possible without handling of the plate, brush or handling. Similarly turning or twisting or unturning or untwisting can loosen or release the different components to achieve the desired combination.

There is provided a method of using a combination toilet cleaning device in at the at least 5 different combination of the device which can exits: handle plus plate with holes; handle plus brush; handle plus plunger; handle plus brush plus plunger; and handle plus plate plus brush and plunger.

The connectors with the handle and plate; the handle with brush; the handle with plunger can be of a screw and/or bayonet type. As such, these 5 different combinations of structure are possible with unscrewing or unbayoneting without handling of each of the plate; brush; or plunger. Similarly, the screwing and/or bayoneting of components can be of nature that assembly in the 5 different combinations is possible without handling of the plate, brush or handling. Similarly, turning or twisting or unturning or untwisting can loosen or release the different components to achieve the desired combination.

The configuration of screwing or bayoneting and interlocking is such that by appropriate turning in a direction as indicted by arrow 31 or 32 or push action 33 or pull action 34 and for bayonet clip or unclip action of the handle 22 with any one or both of the tubular connecter 13 or element 25, the different one or more of the 5 combinations can be achieved.

In one form the engagement of the brush and plunger with the handle is achieved by pushing the handle downwardly and turning in clockwise direction to achieve the engagements of these components. Disengagement is achieved by turning anticlockwise and pulling the handle upwards. In another form without the turning, there can be simply the handle and brush combination after pushing the handle downwards. In a third form simply turning in a selected direction with out pushing can engage the plate and handle only.

Further discussion of the manner of usage and operation of the present disclosure should be apparent from the above description. Accordingly, no further discussion relating to the manner of usage and operation will be provided.

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A janitorial device for cleaning a toilet bowl comprising a handle with selectively a combination of firstly either a cleaning brush mounted at one end of the handle, and a plunger mounted on the handle on the side the brush remote from the handle, or secondly at least two of the cleaning brush mounted at one end of the handle, the plunger mounted on the handle on the side the brush remote from the handle, a hook like plate or device transversely mounted at the handle end near the brush or thirdly at least three of the cleaning brush mounted at one end of the handle, the plunger mounted on the handle on the side the brush remote from the handle, and the hook like plate or device transversely mounted at the handle end near the brush.

2. The device as claimed in claim 1 wherein the brush includes a brush support member, and also including a brush member being attached to the brush support member, and further includes an elongate handle member being removably attached to the brush support member, the brush support member including a plate, and also including a tubular connector disposed in and through the plate and having open top and bottom ends and a bore extending therethrough, and further including elongate threaded members being attached to a top side of the plate, and also including a fastener for connecting with the elongate threaded.

3. The device as claimed in claim 1 including a plunger assembly including a housing/support member and also including a plunger member being attached to the housing/support member, a brush support member being removably fastened to the housing/support member.

4. The device as claimed in claim 1 including a plate disposed above the brush and around the handle, the plate being a round element and being made of a silicone material.

5. The device as claimed in claim 1 wherein a brush member is attached to a bottom side of the plate, and is made of pliable material.

6. The device as claimed in claim 1 wherein a handle member has an annular recessed bottom end portion which is removably threaded into the top end of a connector, and also has a ribbed end portion for a user to easily grip the handle member.

7. The device as claimed in claim 1 wherein a housing/support member has top and side walls, and an open bottom, the top wall having an opening being centrally-disposed therethrough and also having holes being disposed therethrough near a perimeter of the top walls, the side walls, elongate threaded members of a brush support member being removably disposed and being fastenable to the housing/support member with fasteners.

8. The device as claimed in claim 1 wherein the plunger is generally a suction cup having a bottom portion and an accordion top portion.

9. The device as claimed in claim 1 wherein the plate includes apertures in a surface through which water or fluid can drain and trap solid articles above the plate.

10. The device as claimed in claim 1 wherein the plate includes a surface with an upturned rim relative to a base of the plate to trap solid articles above the plate.

11. The device as claimed in claim 1 including connectors and selectively screw thread or bayonet connections between the handle and plate, the handle with brush, and the handle with plunger whereby different combinations of structures are possible with unscrewing or unbayoneting without handling of each of the plate, brush, or plunger and screwing and/or bayoneting of components whereby an assembly in the different combinations is attained without handling of the plate, brush or handling.

12. The device as claimed in claim 1 including a combination at one end of the handle, of a hook like plate or device transversely mounted at the handle end near the brush to extend a required distance diametrically of the handle to permit an object in a toilet bowl to be picked up, the brush and plunger having been removed.

* * * * *